US010301866B2

(12) United States Patent
Margonari et al.

(10) Patent No.: US 10,301,866 B2
(45) Date of Patent: May 28, 2019

(54) HINGE FOR HOUSEHOLD APPLIANCE SUCH AS OVEN

(71) Applicant: Apparatebau Gronbach GmbH, Laag/Neumarkt (IT)

(72) Inventors: Massimiliano Margonari, Trento (IT); Gerold Meurer, Margreid (IT)

(73) Assignee: Apparatebau Gronbach GmbH, Laag/Neumarkt (IT)

( * ) Notice: Subject to any disclaimer, the term of this patent is extended or adjusted under 35 U.S.C. 154(b) by 0 days.

(21) Appl. No.: 15/557,390

(22) PCT Filed: Dec. 8, 2015

(86) PCT No.: PCT/EP2015/002494
§ 371 (c)(1),
(2) Date: Sep. 11, 2017

(87) PCT Pub. No.: WO2016/112939
PCT Pub. Date: Jul. 21, 2016

(65) Prior Publication Data

US 2018/0245391 A1 Aug. 30, 2018

(30) Foreign Application Priority Data

Jan. 13, 2015 (DE) ..... 10 2015 000 407

(51) Int. Cl.
*E05F 15/622* (2015.01)
*F24C 15/02* (2006.01)
*E05F 15/611* (2015.01)

(52) U.S. Cl.
CPC ..... *E05F 15/622* (2015.01); *E05F 15/611* (2015.01); *F24C 15/023* (2013.01); *E05Y 2201/24* (2013.01); *E05Y 2900/30* (2013.01); *E05Y 2900/302* (2013.01); *E05Y 2900/304* (2013.01); *E05Y 2900/308* (2013.01)

(58) Field of Classification Search
CPC ..... E05F 1/1246; E05F 1/14; E05F 15/622; F24C 15/023
USPC ..... 16/280–281, 286
See application file for complete search history.

(56) References Cited

U.S. PATENT DOCUMENTS 5,025,776 A * 6/1991 Hanley ..... E05F 1/1276 126/194
5,937,481 A * 8/1999 Faringosi ..... F24C 15/023 16/332

(Continued)

FOREIGN PATENT DOCUMENTS

DE 102007029696 A1 1/2009
DE 102013001402 A1 7/2014

(Continued)

OTHER PUBLICATIONS

ISA European Patent Office, International Search Report Issued in Application No. PCT/EP2015/002494, dated Feb. 22, 2016, WIPO, 4 pages.

*Primary Examiner* — Roberta S Delisle
(74) *Attorney, Agent, or Firm* — McCoy Russell LLP

(57) ABSTRACT

Hinge, in particular for an oven, with a housing on which a lever arm is stored in a swingable manner, and is activated by a driving gear. In an improved hinge of this type, the driving gear is connected to a tappet, which is connected to exert pressure on the lever arm.

11 Claims, 6 Drawing Sheets

(56) References Cited

U.S. PATENT DOCUMENTS

| | | | | |
|---|---|---|---|---|
| 6,539,581 | B1 * | 4/2003 | Faringosi | E05F 1/1261 126/194 |
| 8,266,765 | B2 * | 9/2012 | Donoho | E05F 1/1276 16/286 |
| 8,533,914 | B2 * | 9/2013 | Vanini | E05F 1/1261 16/286 |
| 8,677,565 | B2 * | 3/2014 | Vanini | A47L 15/4261 16/286 |
| 2003/0172920 | A1 | 9/2003 | Gronbach | |
| 2007/0267401 | A1 * | 11/2007 | Collene | F24C 15/023 219/391 |

FOREIGN PATENT DOCUMENTS

| | | | |
|---|---|---|---|
| EP | 1287222 | B1 | 4/2004 |
| EP | 2759669 | A2 | 7/2014 |
| EP | 2784257 | A1 | 10/2014 |
| WO | 2014111827 | A1 | 7/2014 |
| WO | 2016112939 | A1 | 7/2016 |

* cited by examiner

Fig. 1
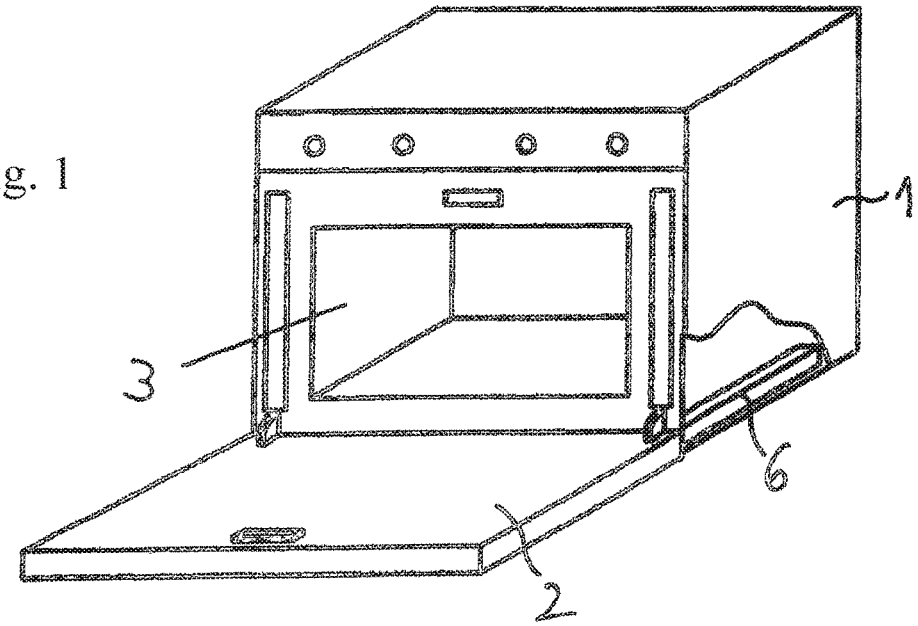
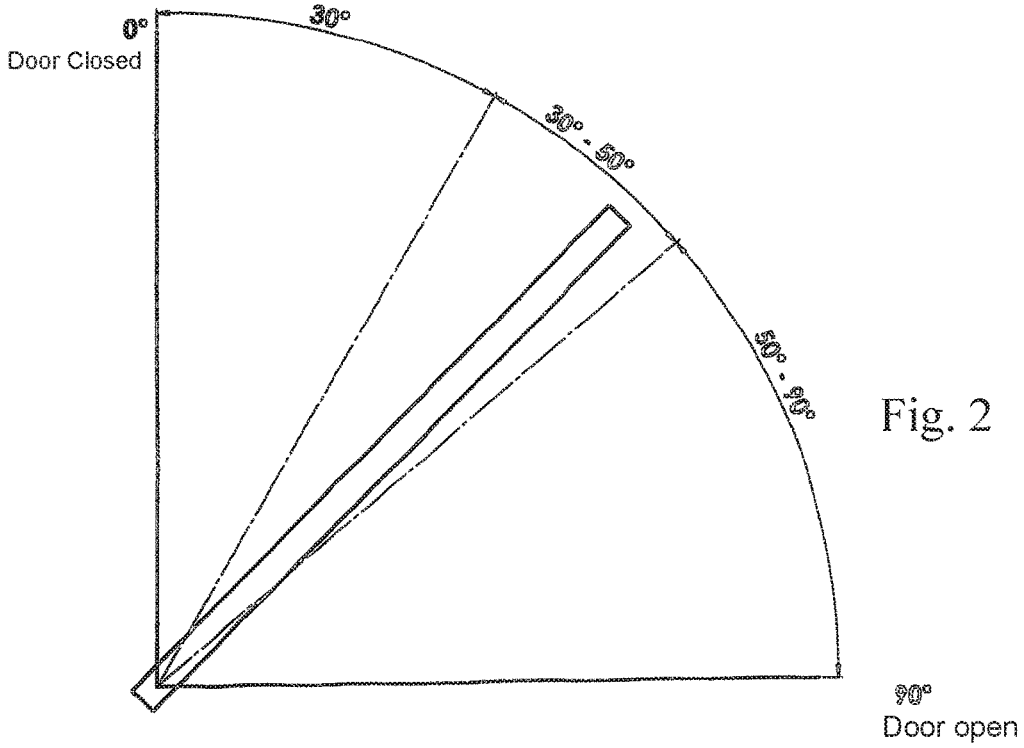
Fig. 2

HINGE FOR HOUSEHOLD APPLIANCE SUCH AS OVEN

CROSS-REFERENCE TO RELATED APPLICATIONS

The present application is a U.S. National Phase of International Patent Application Serial No. PCT/EP2015/002494, entitled "HINGE FOR AN OVEN," filed on Dec. 8, 2015. International Patent Application Serial No. PCT/EP2015/002494 claims priority to German Patent Application No. 10 2015 000 407.7, filed on Jan. 13, 2015. The entire contents of each of the above-mentioned applications are hereby incorporated by reference in their entirety for all purposes.

TECHNICAL FIELD

The invention relates to a hinge, in particular for an oven, a baking oven, or some other device or electric appliance. The invention also relates to an oven or a similar item, in particular a baking oven, or some other device or electric appliance.

BACKGROUND AND SUMMARY

A hinge of the type described in the introduction is known from EP 2 759 669 A2.

A motorized closing movement of the oven door or other device presents the hazard of pinching one's finger between the closing door and the housing of the oven or device. This hazard is the greatest near the pivot of the closing door, since it is here that the closing force is the strongest because of the mechanical advantage.

The task of the invention is to deal with this hazard and to propose an improved hinge, in particular for an oven.

According to the disclosure, this task is solved by the characteristics described herein of a hinge for an oven or similar device. The hinge may be comprised of a housing on which a swingable lever arm is stored, which can be activated by a driving gear. The driving gear can be set up as a linear gear or a rotating gear.

The driving gear can be placed in the housing. However, it can also be arranged over, under, or next to the housing of the hinge. Preferentially the driving gear is connected directly or indirectly with the hinge housing.

The driving gear is preferentially an electromechanical driving gear, in particular an electromechanical linear gear or an electromechanical rotation gear. It is advantageous if the driving gear does not have any automatic locking. This way it is possible to activate the hinge manually as well.

According to the invention, the driving gear is connected with a tappet, which is connected to work on the lever arm by pressure. The tappet can be connected directly or indirectly with the driving gear. In particular is possible that the driving gear has a tappet. The tappet may be directly or indirectly connected to act on the lever arm by pressure. In particular it is possible for the tappet to work directly on the lever arm. However, it can also act on another component, which is connected to act on the lever arm.

Servicing the hinge can be simplified with the driving gear. In addition, comfort can be improved in contrast to standard hinges. It is also possible to create additional protective functions for the device and/or the user.

In the hinge according to the invention, the driving gear presses the hinge directly or indirectly up to the point where the closing door is activated independently. For closing, the closing door can initially be activated manually. To be sure, it is also possible for the closing door to the activated for closing by the motor. Whether closed by motor or manually, the closing door is initially closed until it is completely closed by the closing power of the closing spring. The motorized driving gear does not work up to this final end position. Since the closing door is not closed through motor activation, the hazard of pinching fingers or other parts of the body by the power of the motor is avoided.

Further advantageous embodiments are described below.

It is advantageous if the tappet has a pressure surface to exert pressure on the swing arm in the direction of the open position of the hinge.

Instead of this, or in addition to this, the tappet can have a pressure surface to exert pressure on the swing arm in the direction of the closing position of the hinge.

The pressure surface or surfaces of the tappet may work directly or indirectly on the swing arm.

According to another advantageous embodiment, the hinge comprises a closing spring to exert pressure on the swing arm in the direction of the closed position of the hinge. The closing spring can be made as a tension spring or a pressure spring. It can exert its force directly or indirectly on the lever arm.

It is advantageous if the hinge comprises a carriage that is stored and movable longitudinally, which is activated by the tappet and is connected directly or indirectly with the lever arm. The carriage is connected to the lever arm preferentially by a joint. It is preferentially stored in the housing and movable longitudinally.

According to another advantageous embodiment, the hinge comprises a lever that is connected with the driving gear or the carriage and with the lever arm. The lever is preferentially connected by a joint with the drive gear or the linear drive gear and/or with the carriage and/or with the lever arm.

In an oven or something similar, in particular a baking oven, a device, or an electric appliance with a closing door, the task of the invention is solved through one or more hinges as described herein. The oven or something similar comprises one or several hinges as described herein and possibly two such hinges.

It is advantageous if the housing of the hinge or hinges is arranged in the oven or similar device. In particular, the housing or housings lying in the baking oven may be used. In this way the advantage is achieved that more space is available for the driving gear and that the hinge, because of its deep position in the structure, is not subject to high temperatures that occur in the case of a structure in the closing door.

It can nevertheless also be advantageous if the oven or similar device has a hinge according to the invention and if it or the other hinges are not activated by the driving gear. The "neutral hinges", not activated by a driving gear, may have a closing spring as a weight balance against the closing door. In this way, where only one hinge according to the invention is used, an extensive synchronization of several hinge driving gears may be dispensed with.

It may be especially advantageous if the oven or similar device has two hinges, namely one hinge according to the invention and a hinge that is not activated by a driving gear, whereby this hinge that is not activated by driving gear preferentially has a closing spring. The closing spring preferentially serves as a weight balance against the closing door. The hinges preferentially are located on various sides of the opening of the oven.

Examples of embodiments of the invention are discussed in detail below based on the attached drawings.

BRIEF DESCRIPTION OF THE FIGURES

FIG. 1 shows an oven with a closing door in a perspective view.

FIG. 2 shows a schematic drawing of the opening angle of the closing door of the oven according to FIG. 1.

DETAILED DESCRIPTION

Figure 3:
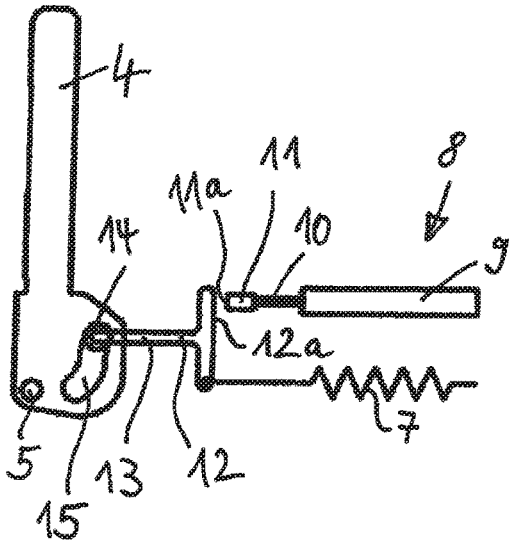
FIG. 3 shows a first embodiment of a hinge for the oven according to FIG. 1 with a carriage in the closed position with an opening angle of 0° in a schematic side view.

FIG. 1 shows an oven 1, on which a closing door 2 is stored and swingable around a horizontal axis. The horizontal lever arm is found under an opening 3 of the baking oven.

FIG. 2 shows the opening angle of the closing door 2 in a schematic view. Thereby the opening angle of 0° corresponds to a closed closing door 2, which in the closed position runs in the vertical direction. The opening angle of 90° corresponds to the completely open closing door 2, which then runs in a horizontal direction, as illustrated in FIG. 1.

FIGS. 3 to 6 show a first embodiment of a hinge for the oven 1 according to FIG. 1. The hinge comprises a housing (not illustrated in the drawing) and a lever arm 4, which is stored as swingable around an axis 5. The housing of the hinge is connected with the oven 1, and the lever arm 4 is connected with the closing door 2. The housing is built lying in the lower area 6 of the oven 1. It runs horizontally and vertically to the lever arm of the closing door 2. The lever arm of the closing door 2 fits in with the axis 5 of the hinge. The lever arm 4 can be set up as an insertable part, which is inserted into a corresponding recess in the closing door 2 and preferentially latched there.

The hinge comprises a closing spring 7, which is formed as a tension spring, and a driving gear 8, which is set up as a linear driving gear. The linear driving gear 8 comprises an actuator 9, in which a driving gear shaft 10 is inserted longitudinally. The driving gear shaft 10 may be activated electromechanically. In the assembled state of the hinge, it is movable horizontally and perpendicular to the axis 5. The closing spring 7 is connected in parallel with the driving gear shaft 10.

The driving gear 8 and the closing spring 7 may be arranged in the housing of the hinge. Alternatively, they may be arranged in a separate housing. This housing may be connected directly or indirectly with the hinge housing. It can be arranged over, under, or next to the hinge housing.

The end of the driving gear shaft 10 turned to the actuator 9 has a tappet 11. The tappet 11 has a pressure surface 11*a* on the end turned toward the actuator 9 and the lever arm 4. The carriage 12 is inserted movable longitudinally into the housing of the hinge, in the same direction as the driving gear shaft 10. It has a counter surface 12*a* on its side turned toward the actuator 9 and the tappet 11. The closing spring 7 is attached on its end with the housing of the hinge or with the housing of the driving gear and on the other end with the carriage 12.

The carriage 12 has a coupling shaft 13, to which a roller 14 is arranged at the end turned toward the driving gear 8. The roller 14 works connected with a drive path 15 of the lever arm 4. It rolls down on the drive path 15.

The drive path 15 is set up exactly or similarly to the corresponding drive path of the hinge in EP 1 287 222 B1, to which reference is expressly made. Through the particular inclination of the drive path 15 toward a circle around the axis 5, the force can be set that is required to open and close the lever arm 4. This force can be exerted by the closing spring 7. Thereby the force of the closing spring 7 may be changed with the driving gear 8. The tension of the closing spring 7 can be changed by a movement of the driving gear shaft 10. It can be changed in a manner that the force exerted by the roller 14 on the drive path 15 moves the lever arm 4 in the desired direction.

Initially the closing door 2 and the lever arm 4 are found in the closed position, as shown in FIG. 3. The tappet 11 is located at a distance from the carriage 12, and the pressure surface 11*a* of the tappet 11 does not press against the counter surface 12*a* of the carriage 12.

If the closing door 2 and the lever arm 4 are to be opened, the driving gear 8 is activated. The driving gear shaft 10 is moved out of the actuator 9 in the direction toward the lever arm 4 and the carriage 12, until the pressure surface 11*a* of the tappet 11 presses against the counter surface 12*a* of the carriage 12. Through a further activation of the driving gear 8 and a further movement of the tappet 11, pressure from the pressure surface 11*a* is exerted on the counter surface 12*a* and thereby on the lever arm 4 in the direction toward opening the hinge. The carriage 12 affects the coupling shaft 13 and the roller 14 on the travel path 15, so that the lever arm 4 is turned around the axis 5. Thereby the driving gear 8 works against the closing moment of the closing spring 7.

Figure 4:
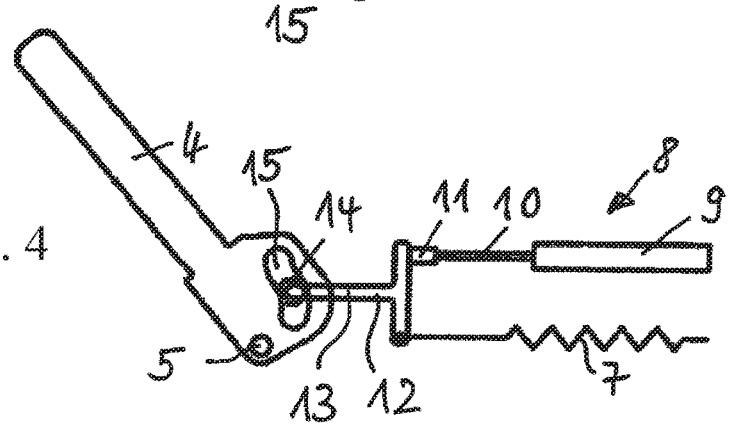
FIG. 4 shows the hinge according to FIG. 3 in a partially open position with an opening angle of 40°.

FIG. 4 illustrates an opening angle of 40°. At this opening angle, the opening moment, through the weight of the closing door 2, is approximately as large as the closing moment from the closing spring 7.

Figure 5:
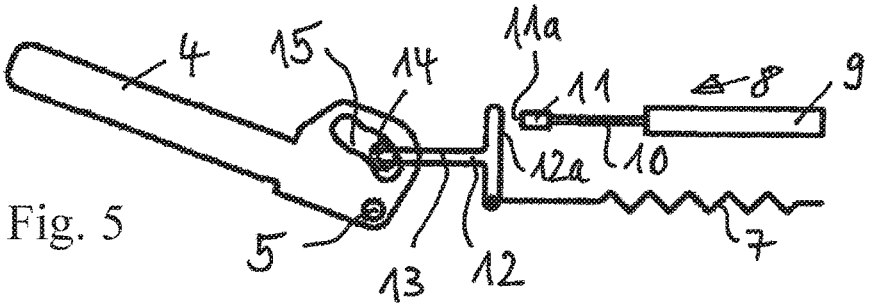
FIG. 5 shows the hinge according to FIGS. 3 and 4 in another partially open position with an opening angle of 70°.

In a further course of the opening movement, a further opening position according to FIG. 5 is achieved in which the opening angle is 70°. By the time an opening angle of 50° is reached, the opening moment, which is created by the opening door 2, overpowers the closing moment, which is called up by the closing spring 7. In this way the counter surface 12*a* is lifted away from the pressure surface 11*a*, as shown in FIG. 5.

Figure 6:
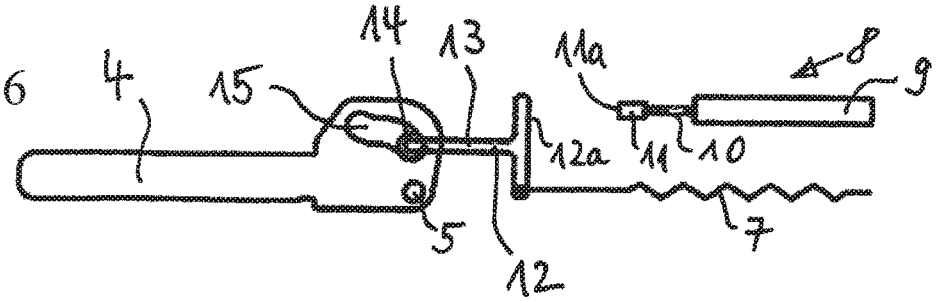
FIG. 6 shows the hinge according to FIGS. 3 to 5 in the completely open position with an opening angle of 90°.
Figure 7:
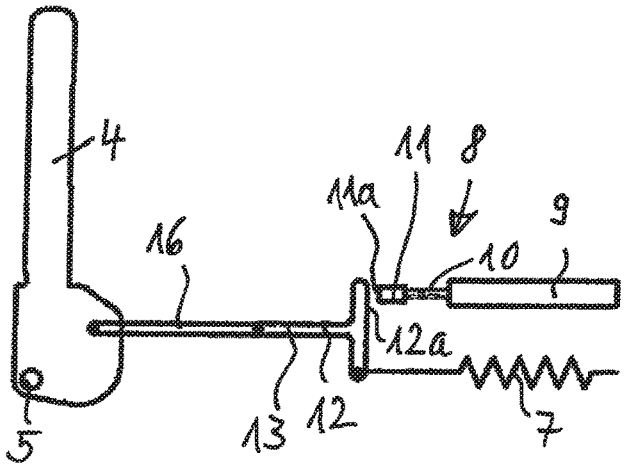
FIG. 7 shows a second embodiment of a hinge for the oven according to FIG. 1 with a carriage and a lever in the closed position with an opening angle of 0° in a schematic side view.
Figure 8:
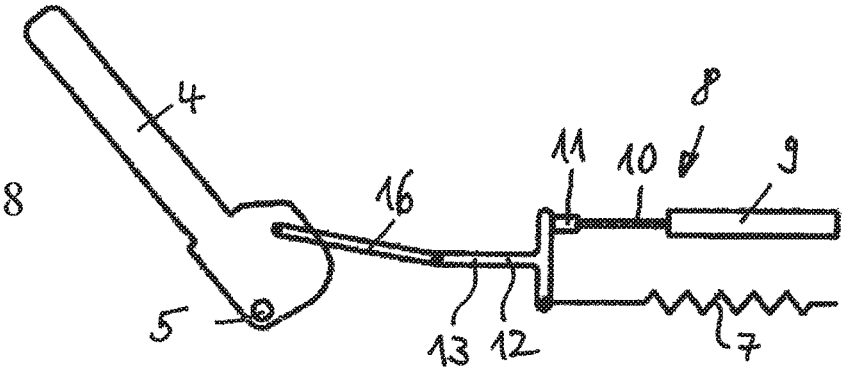
FIG. 8 shows the hinge according to FIG. 7 in a partially open position with an opening angle of 40°.
Figure 9:
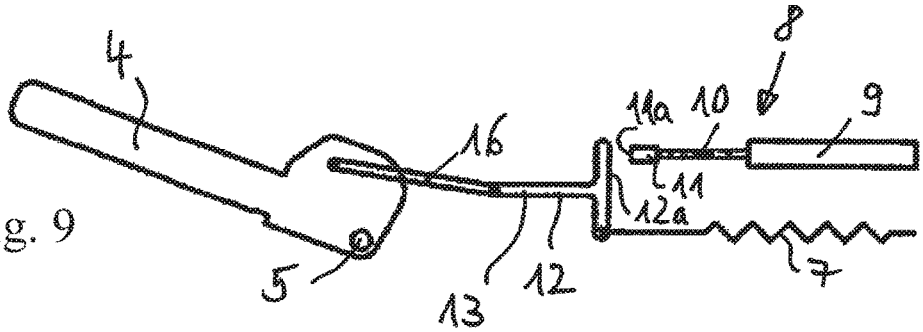
FIG. 9 shows the hinge according to FIGS. 7 and 8 in another partially open position with an opening angle of 70°.
Figure 10:
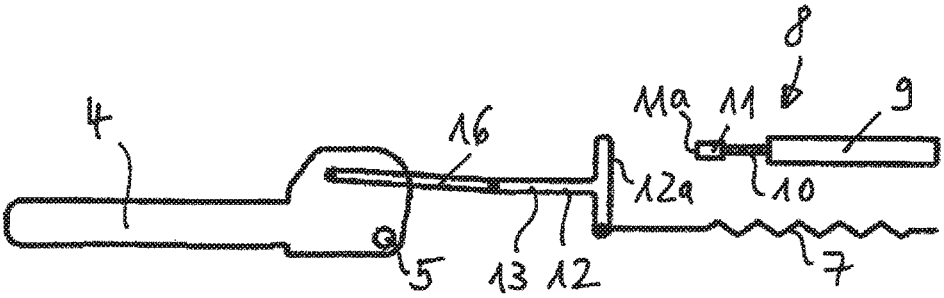
FIG. 10 shows the hinge according to FIGS. 8 to 9 in the completely open position with an opening angle of 90°.
Figure 11:
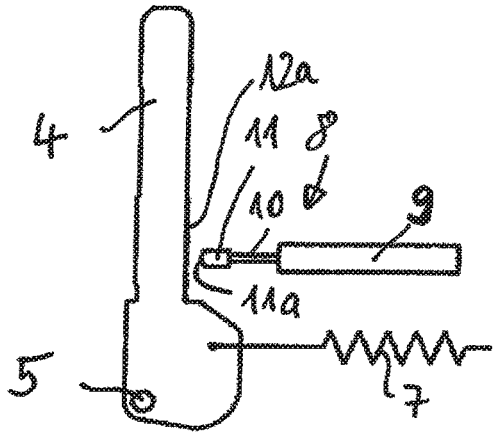
FIG. 11 shows a third embodiment of a hinge for the oven according to FIG. 1 without a carriage and a lever in the closed position with an opening angle of 0° in a schematic side view.
Figure 12:
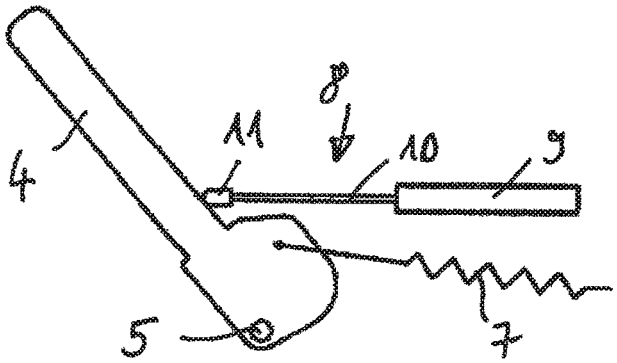
FIG. 12 shows the hinge according to FIG. 11 in a partially open position with an opening angle of 40°.
Figure 13:
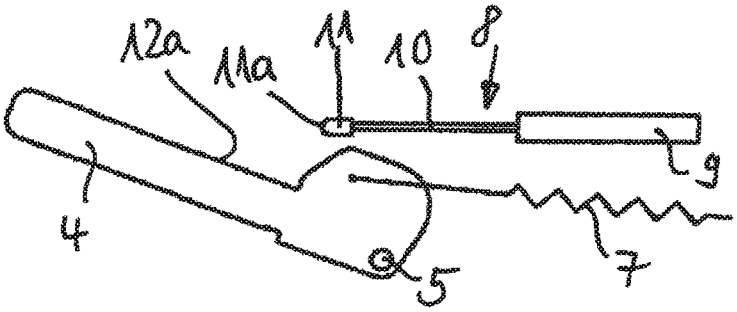
FIG. 13 shows the hinge according to FIGS. 11 and 12 in a partially open position with an opening angle of 70°.
Figure 14:
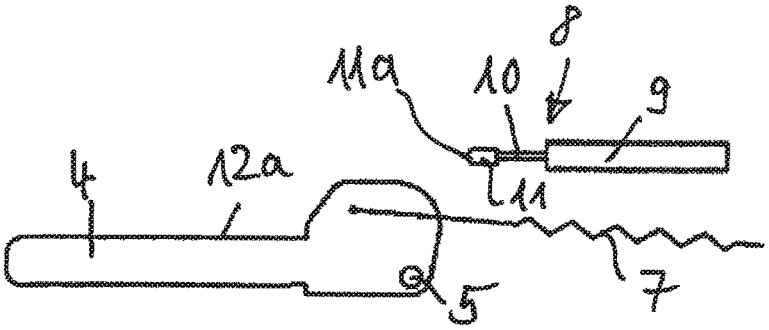
FIG. 14 shows the hinge according to FIGS. 11 to 13 in the completely open position with an opening angle of 90°.

The closing door 2 is further opened by the difference between the opening moment and the closing moment in a self actuating manner and independent of the driving gear 8, until the completely open position, shown in FIG. 6, is achieved. During this further opening movement, the tappet 11 can again be brought in, as shown in FIG. 6.

For closing the closing door 2, the closing door 2 is initially raised manually, whereby the hinge is moved from the position shown in FIG. 6 to the position shown in FIG. 5. In the further course of the closing movement by hand, the position shown in FIG. 4 is achieved, in which the closing moment from the closing spring 7 is slightly greater than the opening moment from the weight of the closing door 2. Now the closing door 2 can be released. The hinge and the closing door are subsequently closed by the action of the self acting closing spring 7.

In case of the failure of the driving gear 8, such as in a current outage, the closing door 2 can also be manually opened and closed. The driving gear 8 in this case does not prevent manually opening the closing door 2 and the hinge arm 4. The same applies to the closing movement.

FIGS. 7 to 10 show a second embodiment of the hinge, in which the corresponding parts are provided with the same parts list numbers and are not described again. In this embodiment, the carriage 12 is attached to the lever arm 4 by a lever 16. The lever is attached to the carriage 12 by a joint. It has the roller 14 on its end turned to the carriage 12.

In the third embodiment according to FIGS. 11 to 14, the tappet 11 directly exerts pressure on the lever arm 4. The tappet 11 directly affects the lever arm 4. The closing spring 7 is directly connected to the lever arm 4.

In the fourth embodiment according to FIGS. 15 to 20, the tappet 11 is formed as a double working tappet. It comprises a first pressure surface 11*a* to exert pressure on the lever arm 4 in the direction of the open position of the hinge, and a second pressure surface 11*b* to exert pressure on the lever arm 4 in the direction of the closed position of the hinge. The pressure surfaces 11*a*, 11*b* lie opposite one another. They are arranged at a distance from one another. The pressure surfaces 11*a* and 11*b* run parallel to one another.

In a corresponding manner, the carriage 12 comprises a first counter surface 12*a* for the first pressure surface 11*a* and a second counter surface 12*b* for the second pressure surface 11*b*. The first counter surface 12*a* and the second counter surface 12*b* run parallel to one another at a distance. They lie opposite one another. Their separation distance is smaller than the distance between the pressure surfaces 11*a* and 11*b*.

Figure 15:
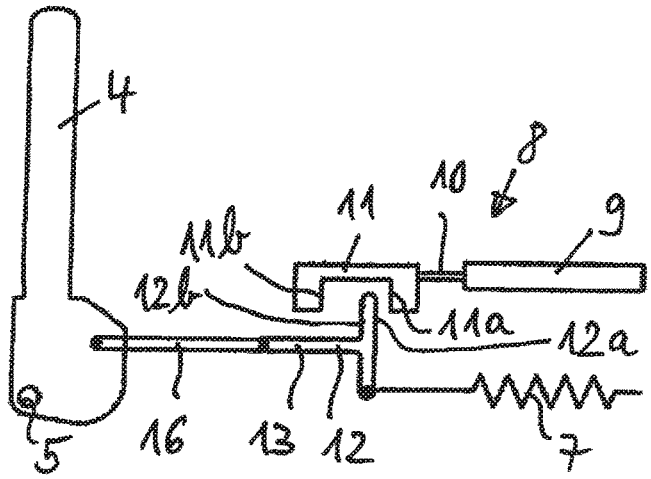
FIG. 15 shows a fourth embodiment of a hinge for the oven according to FIG. 1 with a carriage, a lever, and a double acting tappet in the closed position with an opening angle of 0° in a schematic side view.

Initially the closing door 2 and the lever arm 4 are found in the closed position, as shown in FIG. 15. The pressure surfaces 11*a*, 11*b* are found at a distance from the counter surfaces 12*a*, 12*b*.

If the closing door 2 and the lever arm 4 are to be opened, the driving gear 8 is activated. The driving gear shaft 10 is moved out of the actuator 9 in the direction toward the lever arm 4 and the carriage 12, until the first pressure surface 11*a* of the tappet 11 presses against the counter surface 12*a* of the carriage 12. Through a further activation of the driving gear 8 and a further movement of the tappet 11, pressure from the pressure surface 11*a* is exerted on the counter surface 12*a* and thereby on the lever arm 4 in the direction toward the open position of the hinge. Thereby the driving gear 8 works against the closing moment of the closing spring 7.

Figure 16:
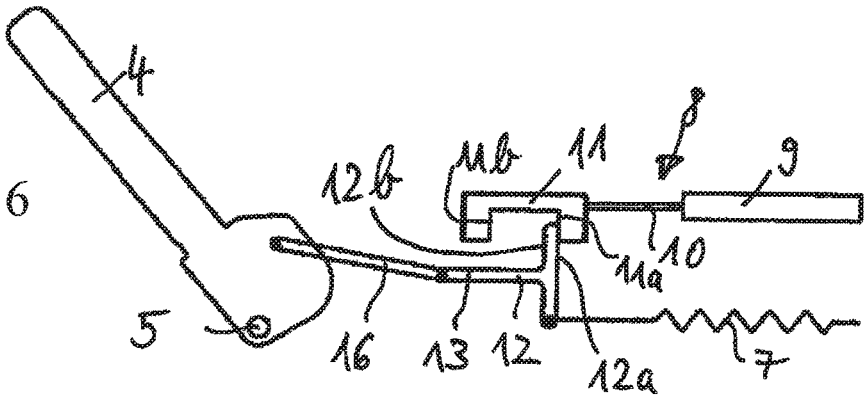
FIG. 16 shows the hinge according to FIG. 15 in a partially open position with an opening angle of 40°.

FIG. 16 illustrates an opening angle of 40°. At this opening angle, the opening moment, through the weight of the closing door 2, is approximately as large as the closing moment from the closing spring 7.

Figure 17:
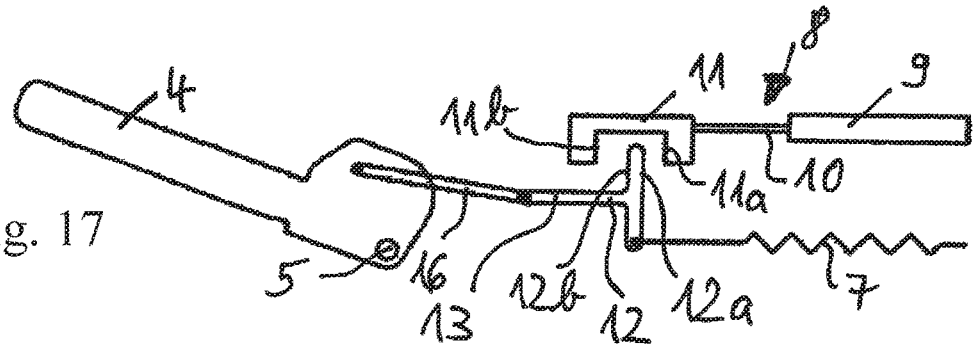
FIG. 17 shows the hinge according to FIGS. 15 and 16 during the opening movement in another partially open position with an opening angle of 70°.

In a further course of the opening movement, a further opening position according to FIG. 17 is achieved in which the opening angle is 70°. By the time an opening angle of 50° is reached, the opening moment, which is created by the opening door 2, overpowers the closing moment, which is called up by the closing spring 7. In this way the first counter surface 12*a* is lifted away from the first pressure surface 11*a*, as shown in FIG. 17.

Figure 18:
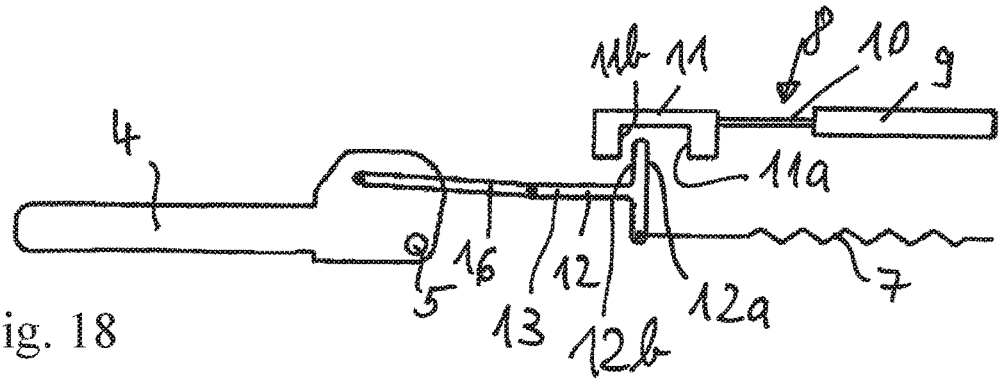
FIG. 18 shows the hinge according to FIGS. 15 to 17 in the completely open position with an opening angle of 90°.

The closing door 2 is further opened by the difference between the opening moment and the closing moment in a self actuating manner and independent of the driving gear 8, until the completely open position, shown in FIG. 18, is achieved. During this further opening movement, the tappet 11 can again be brought in, as shown in FIG. 18.

To close the closing door 2, the driving gear 8 is activated in the opposite direction. The driving gear shaft 10 is moved into the actuator 9 in the direction from the lever arm 4 and the carriage 12, until the second pressure surface 11*b* of the tappet 11 leans against the counter surface 12*b* of the carriage 12. Through a further activation of the driving gear 8 and a further movement of the tappet 11, pressure from the second pressure surface 11*b* is exerted on the second counter surface 12*b* and thereby on the lever arm 4 in the direction toward closing the hinge. The carriage 12 drives the coupling shaft 13 and the roller 14 on the travel path 15, so that the lever arm 4 is turned around the axis 5. Thereby the driving gear works against the opening moment of the closing door 2.

Figure 19:
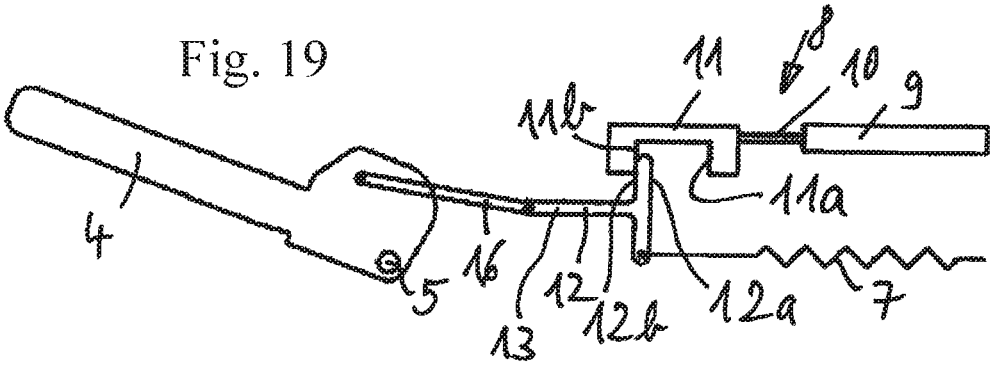
FIG. 19 shows the hinge according to FIGS. 15 to 18 during the closing movement in a partially open position with an opening angle of 70°.

FIG. 19 illustrates an opening angle of 70°. At this opening angle, the opening moment, through the weight of the closing door 2, is greater than the closing moment from the closing spring. The closing door 2 and the lever arm 4 are moved by the driving gear 8 in the closing direction.

Figure 20:
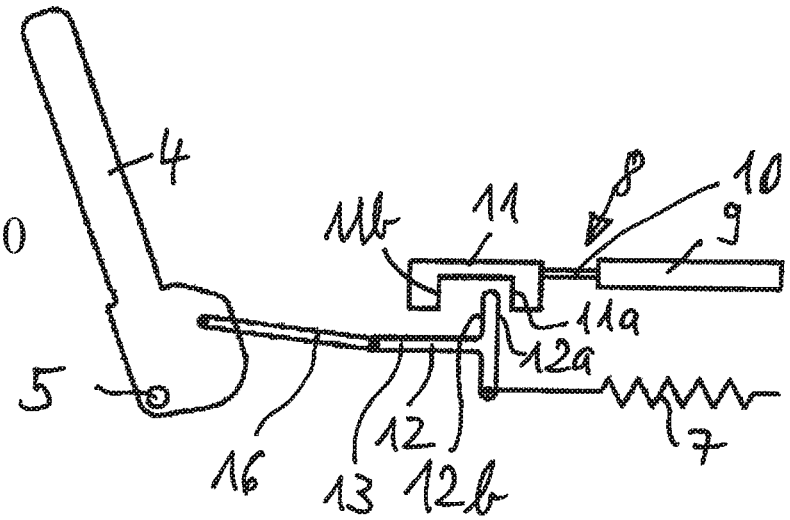
FIG. 20 shows the hinge according to FIGS. 15 to 19 during the closing movement in another partially open position with an opening angle of 20°.

In a further course of the opening movement, a further partially open position according to FIG. 20 is achieved in which the opening angle is 20°. In this position, the closing moment from the closing spring 7 outweighs the opening moment from the closing door 2. In this way the second counter surface 12*b* lifts off from the second pressure surface 11*b*, as shown in FIG. 20. The closing door 2 and the lever arm 4 are further self activated by the closing moments of the closing spring 7, and are closed independently of the driving gear 8 until the completely closed position shown in FIG. 15 is reached.

In case of the failure of the driving gear 8, such as in a current outage, the closing door 2 can also be manually opened and closed. The driving gear 8 in this case does not prevent manually opening the closing door 2 and the hinge arm 4. The same applies to the closing movement.

A hinge is created by the invention for which the hazard of pinching under motor force can be prevented. The hinge can be so set up that up to an opening angle of about 30°, the closing door closes through spring pressure, and with a closed closing door enough closing pressure is created for the closing door to be pressed with sufficient force against the insulation. At an opening angle of about 30° to 50°, the closing door is balanced. From around 50° and above, the closing door through its own weight falls into the open position, which can be limited by an end stop. It is advantageous if both end stops for the closed closing door and for the open closing door are muffled. It is also possible that one or several mufflers can exist for the open position of the closing door and/or for the closed position of the closing door.

According to the invention, the closing door can be moved by motor both in the open position and in the closed position. It is however also possible that the closing door is moved by the motor only in the open position or only in the closed position, and is moved manually in the other position. In all cases it is possible to move the hinge and the closing door manually in the case of a failure of the driving gear.

The invention claimed is:

1. A hinge for an oven including, a housing on which a lever arm is stored in a swingable manner, and is activated by a driving gear, wherein the driving gear is connected with a tappet which exerts pressure on the lever arm and the tappet is disconnected from the lever arm at a first position during closing and a second position during opening.

2. The hinge according to claim 1, wherein the tappet has a pressure surface to exert pressure on the lever arm in a direction of an open position of the hinge.

3. The hinge according to claim 1, wherein the tappet has a pressure surface to exert pressure on the lever arm in a direction of a closed position of the hinge.

4. The hinge according to claim 1, wherein a closing spring exerts force on the lever arm in a direction of a closed position of the hinge.

5. The hinge according to claim 1, wherein a carriage stored and movable longitudinally is activated by the tappet and is connected with the lever arm.

6. The hinge according to claim 1, wherein a lever is connected to the driving gear or the carriage and to the lever arm.

7. An oven or similar device with a closing door, including one or several hinges including, a housing on which a lever arm is stored, and is activated by a driving gear, wherein the driving gear is connected with a tappet, and the tappet including two faces which exert pressure on the lever arm in two directions and the tappet is disconnected at a position at which a spring pulls the lever arm from contact with the tappet.

8. The oven or similar device according to claim 7, wherein the housing of the hinge or hinges is arranged in the oven or in the similar device.

9. The oven or similar device according to claim 7, including the hinge and one or several hinges that are not activated by the driving gear.

10. The oven or similar device according to claim 9, including the hinge, and a hinge that cannot be activated by the driving gear and that has a spring.

11. A hinge for an oven including, a housing on which a lever arm is stored, a driving gear and a spring connected to the lever arm, wherein the driving gear is connected with a tappet which exerts pressure on the lever arm and the tappet is disconnected from the lever arm in a position at which a weight of an oven door exceeds a spring force.

* * * * *